United States Patent [19]

Dillon et al.

[11] 4,327,156

[45] Apr. 27, 1982

[54] INFILTRATED POWDERED METAL COMPOSITE ARTICLE

[75] Inventors: Kenneth R. Dillon, White Bear Lake; Richard N. Gardner, Stillwater, both of Minn.

[73] Assignee: Minnesota Mining and Manufacturing Company, St. Paul, Minn.

[21] Appl. No.: 148,809

[22] Filed: May 12, 1980

[51] Int. Cl.[3] ..... B22F 3/00; C22C 1/05

[52] U.S. Cl. ..... 428/568; 428/567; 428/545; 75/203; 75/204; 75/208 R

[58] Field of Search ..... 75/203, 204, 208 R; 428/568, 567, 545

[56] References Cited

U.S. PATENT DOCUMENTS

| | | | |
|---|---|---|---|
| 3,258,817 | 7/1966 | Smiley | 164/496 |
| 3,779,715 | 12/1973 | Wendler et al. | 428/568 |
| 3,806,325 | 4/1974 | Niimi et al. | 428/568 |
| 3,812,565 | 5/1974 | Seino et al. | 428/568 |
| 3,823,002 | 7/1974 | Kirby, Jr. et al. | 428/567 |
| 3,827,863 | 8/1974 | Takahasi et al. | 428/568 |
| 3,829,295 | 8/1974 | Farmer et al. | 428/568 |
| 3,929,476 | 12/1975 | Kirby, Jr. et al. | 75/214 |
| 4,024,902 | 5/1977 | Baum | 164/97 |
| 4,140,170 | 2/1979 | Baum | 164/493 |

FOREIGN PATENT DOCUMENTS 2005728 9/1978 United Kingdom .

OTHER PUBLICATIONS

Harding et al. "Wetting of Ceramic Oxides by Molten Metals. . .", Amer. Cer. Soc. 53, 2, pp. 87–90, (1970).

Rhee, "The Wetting of Ta C by Liquid Cu and Liquid Ag" Amer Cer Soc., 55, 3, pp. 157–159, (1972).

*Primary Examiner*—Brooks H. Hunt

*Attorney, Agent, or Firm*—Cruzan Alexander; Donald M. Sell; David R. Cleveland

[57] ABSTRACT

A precision molded article, such as a die cavity, is made by combining granules of a refractory and granules of a first metal or alloy which has a homogeneous crystalline appearance at a temperature below its melting point and has a lower Rockwell Hardness than the refractory, mixing the granules with a heat fugitive organic binder, molding the granule-binder mixture into a green molded preform, thermally degrading and removing essentially all the binder to form a skeletal preform, and infiltrating the preform with a second metal or alloy which will wet the first metal or alloy and has a lower Rockwell Hardness than the first metal or alloy, thereby forming a molded article having refractory granules fully enveloped within a single skeleton of the first metal or alloy, the refractory granules and skeleton of first metal being surrounded by layers or matrices of softer metals.

37 Claims, 4 Drawing Figures

INFILTRATED POWDERED METAL COMPOSITE ARTICLE

TECHNICAL FIELD

This invention relates to powder metallurgy, metal composite materials containing impact resistant and abrasion resistant components, precision molded articles made from such materials, and a process for forming said articles.

BACKGROUND ART

Powder metallurgy techniques have been used to formulate refractory metal composite materials with both high hardness and high impact strength. U.S. Pat. No. 4,024,902 describes a composite material made from cemented carbide particles containing tungsten carbide and cobalt, the cemented carbide particles being placed in a mold and infiltrated with molten steel alloy. The tungsten carbide and cobalt dissolved in the steel alloy and then precipitate from the alloy as the article is cooled. The resultant composite article contains particles of tungsten carbide surrounded by successive shells containing tungsten (from the tungsten carbide), carbon (from the tungsten carbide), cobalt, and steel, each of these shells having lower hardness than the tungsten carbide particles. The remainder of the article is occupied by the steel alloy. The hardest material in such a composite is tungsten carbide, and the softest material in such a composite is steel alloy. U.S. Pat. No. 4,140,170 describes an improvement in the molding process of U.S. Pat. No. 4,024,902. According to the method of the latter patent, sintered tungsten carbide is ground up and mixed with iron powder. The powder mixture is then packed in a mold and heated to form a composite material. The methods of these patents employ liquid phase reactions which are not suitable for the precision replication of a molded shape, due to dimensional changes which occur as the materials within the composite chemically combine with one another.

U.S. Pat. No. 3,258,817 describes a composite material made by placing spheroidal, refractory, hard metal particles in a mold, infiltrating the particles with a molten binder metal having a melting point between 816° C. and 1649° C., and cooling the infiltrated article. The refractory particles partially dissolve in the binder metal during infiltration, then precipitate from the binder during cooling of the article. The process conditions are said to be preferably controlled so as to cause an "intergrowth" of the refractory granules and formation of a continuous hard metal phase. Such a composite material would have low impact resistance due to the interconnection or intergrowth of refractory granules, since this would provide an efficient pathway for crack propagation through the material. Also, the method of this patent might be unsuitable for the precision replication of a molded shape due to the use of liquid phase reactions.

U.S. Pat. Nos. 3,823,002 and 3,929,476 describe precision shaped articles, such as electrical discharge machining electrodes, made by molding in a flexible mold a plastic mixture of multimodal refractory powders and a thermoplastic binder to form a green molded article of predetermined shape and dimensions, heating the green molded article to remove the binder and consolidate the refractory powders into an interconnected skeletal structure, and infiltrating the resulting skeletal structure with a molten infiltrant which is a low melting point metal or alloy.

U.K. published Patent Application No. 2,005,728 A describes a molded, non-refractory metal article made by molding in a flexible mold a plastic mixture of non-refractory, spherical metal powders and heat-fugitive binder comprising thermoplastic material to form a green article of predetermined shape and dimensions, heating the green article to remove the binder and consolidate the non-refractory spherical powders in the form of a porous, monolithic skeleton of necked particles of non-refractory metal, infiltration the skeleton with a molten metal having a melting point that is at least 25° C. less than the melting point of the lowest melting of the spherical, non-refractory particles, and cooling the metal infiltrated skeleton thereby forming a homogeneous, void-free non-refractory metal article of two intermeshed metal matrices. The molded skeleton may be made of particles of Fe, Co, Ni, or their alloys and the infiltrant metal may be Cu, Ag, or Sn.

DISCLOSURE OF INVENTION

It is an object of the present invention to provide metal composite articles having desirable physical properties such as abrasion resistance, high hardness, and high impact strength. Another object of the present invention is to provide precision molded metal composite articles which replicate the shape of an original shape or master. Another object of the present invention is to provide a composite material useful in the manufacture of die cavities. It is a further object of the present invention to provide a process for making precision molded articles from such composite materials.

The present invention provides, in one aspect, a metal composite article, comprising:

(a) granules of a refractory of about 1 to 100 micrometers mean diameter, said refractory being
  (i) metal carbide, boride, oxide, silicide, or nitride, or
  (ii) metal selected from the group consisting of tungsten, molybdenum, tantalum, niobium, vanadium and titanium, or
  (iii) combinations thereof;

(b) a monolithic skeleton comprising a solid first metal or alloy which has a homogeneous crystalline appearance at a temperature below its melting point when viewed under an optical microscope and has lower Rockwell hardness than said refractory, said first metal or alloy fully enveloping said refractory granules, the latter being uniformly dispersed in said skeleton; and (c) a continuous metallic phase occupying the connected porosity in said skeleton, said continuous phase comprising a solid second metal or alloy which wets said skeleton, has a Rockwell hardness less than or equal to the Rockwell hardness of said first metal or alloy, and has a melting point below the melting point of said first metal or alloy;

said article thereby comprising two intermeshed matrices and being substantially free of voids.

BRIEF DESCRIPTION OF DRAWING

In the accompanying drawing.

DETAILED DESCRIPTION

Figure 1:
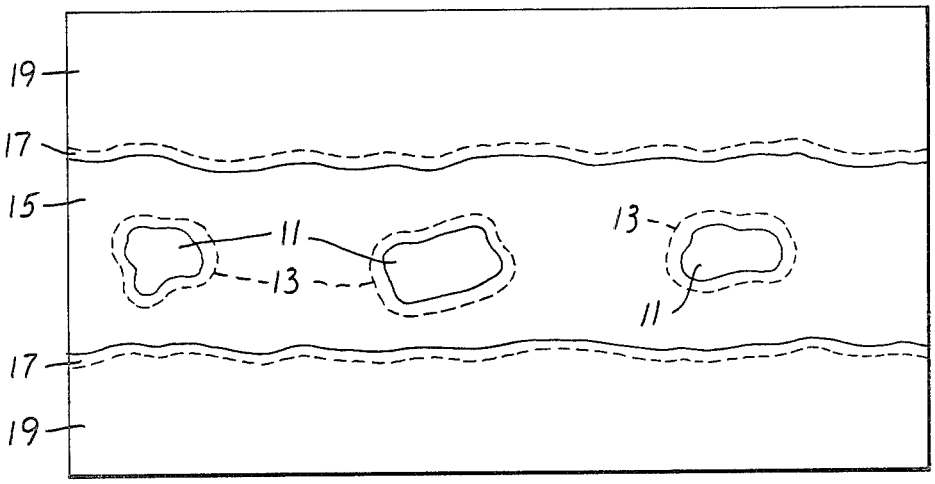
FIG. 1 is a schematic diagram of a portion of an article of this invention.

In the practice of this invention, a replicating master of the desired shape and size is used to prepare a flexible rubber mold. Next, granules of said refractory metal carbide, boride, oxide, silicide, nitride, or the aforementioned refractory metals, or said combinations thereof (viz., component (a) above, hereafter referred to collectively as "refractory" or "refractory granules") are mixed with granules of said first metal or alloy (viz., that of skeleton (b) above, hereafter referred to collectively as the "first metal"). The resulting powder mixture is mixed with a heat fugitive binder and the powder-binder mixture is then placed in said mold and thereby molded into a shape that is the same as the desired final shape. The powder-binder mixture is cured in the flexible mold and the resulting cured, molded "green" article is demolded and heated to thermally degrade and remove essentially all of the binder. The resulting porous molded shape or "perform" is then infiltrated at a temperature below the melting point of the first metal with said second metal or alloy (hereafter referred to as the "infiltrant"). During the infiltration step, contiguous granules of the refractory and the first metal undergo sintering by volume diffusion, whereby the first metal granules lose their original particle shape and merge or consolidate to form a monolithic skeletal structure which fully envelopes or surrounds the refractory granules. The first metal granules thereby undergo extensive change in their original shape. The elements of the skeleton are in turn surrounded by the infiltrant. After cooling the final article, the infiltrated skeleton corresponds in shape to that of the replicating master. In this skeleton, the connected porosity (i.e., void space which is not sealed off or isolated from porosity which communicates with the exterior of the skeleton, in contrast to "closed porosity" which is inacessible void space wholly within the body of the skeleton) is occupied by the infiltrant. The infiltrated, molded article contains dispersed (i.e., not interconnected) refractory granules, each of which is surrounded by a gradient microstructure of materials of lower hardness and greater impact strength. The article as a whole exhibits high abrasion resistance, high hardness, and high impact strength, and is a faithful replica of the master used to prepare the mold from which the molded preform was made.

By "gradient microstructure" is meant a heterogeneous crystalline structure containing a plurality of contiguous crystalline regions, each in the form of a shell or plurality of contiguous shells surrounding, encircling, or enveloping a refractory granule, the shells exhibiting a progressive, gradual change with respect to physical properties, such as Rockwell hardness and impact strength, as measured radially outward from any individual refractory granule. Such a gradient microstructure results in a composite article having bulk physical properties which in total are not exhibited by any single component (viz., the refractory, first metal, or infiltrant) within the composite article.

The volume diffusion phenomenon mentioned above is a solid state reaction which occurs below the melting point of the first metal. The manner in which this reaction occurs may be described as "particle encirclement by diffusional transport means" and is believed to be previously unknown in the art of powder metallurgy. Despite the extensive change in shape of the granules of first metal which occurs, and the consolidation of the granules of first metal into a monolithic skeleton, the finished composite article of the present invention exhibits surprisingly little change in shape or size, when compared to the dimensional changes typically encountered in iron-containing powdered metal composite articles.

The gradient microstructure of a molded article of the present invention can be further understood by reference to FIG. 1. Referring to FIG. 1, shown in schematic view are refractory granules 11. These refractory granules are fully enveloped by first metal 15. First metal 15 is in turn surrounded by infiltrant 19 (the second metal). The refractory granules are not in contact with infiltrant 19.

Optionally, one or more layers or shells of an intermediate composition of refractory together with first metal, such as layer 13, are disposed between refractory granules 11 and first metal 15. These intermediate layers of refractory together with first metal may tend to form under some process conditions between the refractory granules and first metal if the refractory is soluble in the first metal. The presence of intermediate layers of refractory together with first metal is not required in this invention. When present, intermediate layers of refractory together with first metal tend to improve the impact resistance and hardness of the final molded composite articles of this invention by making more gradual the change in impact resistance and hardness between the first metal and refractory within the microstructure of the final article.

Optionally, one or more layers or shells of intermediate alloy, such as layer 17, are disposed between the first metal and infiltrant. These intermediate layers may tend to form under some process conditions if the principal metal of the infiltrant (or an alloying metal present therein) is reactive with the first metal. The presence of intermediate alloy layers such as layer 17 is not required in this invention. When present, such intermediate layers tend to improve the impact resistance and hardness of the final molded composite articles of this invention by making more gradual the change in impact resistance and hardness between the infiltrant and first metal within the microstructure of the final article.

When a representative metallurgically-prepared cross-section of the article of this invention is examined with a light microscope at a magnification at which said two matrices are discernible, e.g., 150×, the refractory granules are essentially uniformly distributed throughout the skeleton formed by the first metal, and the first metal and infiltrant are essentially uniformly distributed throughout the article. Of course, at much higher magnifications, the refractory granules, first metal, and infiltrant may no longer appear to be uniformly distributed within the field of view. There is no unique axis or densification of the refractory granules in any portion of the skeleton (especially in the peripheral portion, i.e., the portion adjacent the surface of the article), such as that otherwise indicative of the use of pressure to shape the final article. The molded articles of the present invention are essentially free of interior and surface defects, such as voids or pits, and exhibit physical, chemical, electrical and mechanical properties which are uniform from article to article.

Minimal shrinkage occurs during sintering of the skeleton and infiltration thereof, the amount of such minimal shrinkage depending upon the process parameters chosen. With compensation for process shrinkage, a precision tolerance, i.e. the percent deviation of the dimensions of the final infiltrated article from blue print specification, of within less than about ±0.2% can be obtained, e.g. ±0.1%.

The uniform properties from article to article and precision tolerance of the articles of this invention means that these articles are particularly well-suited for applications where high hardness, wear and impact resistance, and close dimensional tolerances are desirable, such as articles with intricate or complex shapes and surfaces with fine details, e.g. stamping and injection molding die cavities which are used to make metal or plastic parts whose shape corresponds to the shape of the die. Articles prepared according to the present invention can exhibit Rockwell hardness greater than about 50 together with Charpy unnotched impact strengths greater than about 15 joules (11 ft. lbs.).

The replicating master used to prepare molded articles according to the present invention can be made in a conventional manner from wood, plastic, metal, or other machinable or formable material. If a molded article prepared according to the process of the present invention exhibits significant dimensional change (e.g. shrinkage) then the dimensions of the replicating master can be adjusted (e.g. made larger) to compensate for those dimensional changes occurring during processing. Such adjustment may be desirable in the manufacture of large articles of this invention, such as articles with a volume of 1 liter or more.

The molding materials which can be used to prepare a flexible mold in the process of this invention are those which cure to an elastic or flexible rubbery form and generally have a Shore A durometer value of about 25–60, and reproduce the fine details of the replicating master without significant dimensional change, e.g. without more than 1 percent linear change from the replicating master. The molding materials should not be degraded when heated to molding temperatures, e.g. 180° C., and desirably should have a low cure temperature, e.g. room temperature. A low temperature curing molding material will form a mold which exhibits a close dimensional control from master to mold, while a high temperature curing molding material will generally produce a mold having dimensions which differ undesirably from those of the master. To maintain dimensional control, it is preferable that the mold material have a low sensitivity to moisture. Examples of suitable molding materials are curable silicone rubbers, such as those described in Bulletin "RTV" 08-347 of January, 1969, of the Dow Corning Co., and low exotherm urethane resins. Such molding materials cure to an elastic or rubbery form having a low post cure shrinkage. The molding material can be optionally reinforced by the addition of about 30 volume percent of less than 44 micrometer diameter glass beads which may improve dimensional control in the molding process.

The amount of molding material used to form a mold of the replicating master can vary depending on the particular molding material used and the shape of the replicating master. It has been found that about 10 to 14 cubic centimeters of molding material for each cubic centimeter of the replicating master will form a mold which retains the desired flexible properties and also has sufficient strength to support the small hydrostatic head produced by the warm powder-binder mixture in the mold before solidification of the binder.

The molding conditions, hereinafter discussed, for molding the articles of this invention permit the use of an inexpensive, soft, elastic or rubbery mold because the only pressure applied is the hydrostatic head of the warm powder-binder mixture in the mold, which pressure is very small and causes negligible distortion. The mild molding conditions thus help ensure a precisely molded green article even though a highly deformable mold is used. In addition, the molding technique results in a molded green article with a uniform density.

The refractory granules are preferably present in the final molded, infiltrated article in amounts less than about 15 volume percent. If the refractory granules have a mean diameter of approximately 50 micrometers, then the refractory granules are preferably present in amounts between about 5 and about 15 volume percent. If the refractory granules have a mean diameter of about 15 micrometers or less, then the refractory granules are preferably present in amounts between about 2 and about 15 volume percent. Larger amounts of refractory can be employed when higher abrasion resistance is desired in the infiltrated article, but the impact strength of such an article may be lower, because excessive loadings of refractory granules lead to contiguous packing of refractory granules and an article which is more prone to crack propagation throughout its interior. For an optimum relationship of impact resistance and hardness, less than 15 volume percent, and preferably about 8 to about 13 volume percent, of the final article is refractory. The refractory granules used to make the final molded article can be regularly or irregularly shaped particles having an original mean diameter of about 1 to about 100 micrometers, preferably about 1 to about 50 micrometers, most preferably about 1 to about 25 micrometers (as determined by Coulter Counter). Use of refractory granules having a low original mean diameter results in formation of a final shaped article having a smooth surface finish. However, if substantial quantities of refractory granules having a mean diameter less than about 1 micrometer are used, formation of the desired gradient microstructure apparently cannot be obtained.

Suitable refractory granules useful in this invention include elemental refractory metals such as W, Mo, Ta, Nb, V, and Ti, carbides of metals such as B, W, Mo, Si, Ti, V, Nb, Ta, and Cr, borides of refractory metals such as Ti, Zr, and V, oxides of metals such as Al, Zr, Hf and Si, silicides of refractory metals such as W and Mo, and nitrides of metals such as Al. The chosen refractory should have a sufficiently limited solubility in the first metal so that the refractory granules do not completely dissolve in the first metal during processing of the composite article. Also, the refractory should desirably be sufficiently stable to withstand the processing conditions and temperatures at which infiltration is carried out without undergoing decomposition. This processing consideration can be satisfied by examining equilibrium solubility and rate of solubilization data for a given refractory-first metal combination, or by empirically infiltrating, sectioning and examining one or more test composite articles and noting the change in refractory granule size which takes place during infiltration. Tungsten carbide is the preferred refractory in a composite article in which the first metal is iron or ferroalloy.

The first metal is solid and must be homogeneous at a temperature below its melting point. By "solid" is meant that the first metal in the final article is a solid at room temperature. By "homogeneous" is meant that at some temperature below the temperature at which the first metal liquifies, the first metal must form a crystalline solid solution which has a homogeneous crystalline appearance when viewed under an optical microscope. The first metal need not be homogeneous at room temperature and need not be homogeneous at all temperatures below its melting point. It merely must be homogeneous at some temperature below its melting point without phase separation. The first metal must also have a Rockwell hardness less than the Rockwell hardness of the refractory as measured under similar test conditions using ASTM E-103-61 (Reapproved 1979). Also, the first metal must be capable of undergoing volume diffusion at some temperature below its melting point when in admixture with the refractory granules and the liquefied infiltrant. By "volume diffusion" is meant a solid-state sintering reaction occurring during heating of contiguous metal particles. Volume diffusion (sometimes referred to as "lattice diffusion") is characterized by the spontaneous movement of atoms or molecules from the interior of contiguous metal particles to the previously unoccupied space between contiguous metal particles. Volume diffusion can be recognized by the occurrence of "necking" between contiguous metal particles (i.e., formation of an enlarged contact area with a concave edge profile) and by a concurrent change in the shape of the remaining (unnecked) outer surface of contiguous metal particles. Volume diffusion may be contrasted with a different solid-state sintering reaction referred to as "surface diffusion". Surface diffusion is characterized by the spontaneous movement of atoms or molecules from the surface of contiguous metal particles to the previously unoccupied space between contiguous metal particles. Surface diffusion can be recognized by the occurrence of necking without a concurrent change in the shape of the remaining (unnecked) outer surface of contiguous metal particles. The necking and particle shape change phenomena referred to above are generally detected by sectioning and polishing a sintered, cooled powdered metal composite and examining the polished surface under optical magnification.

The processing conditions necessary to promote volume diffusion in an article of this invention may tend to vary as the shape or volume of that article is altered. Volume diffusion is both time and temperature dependent, and is more likely to take place as the time and/or temperature at which infiltration is carried out is increased. If an infiltrated article undergoes only surface diffusion, it will have less than optimum impact resistance because the refractory granules will not become fully enveloped by the first metal, and in the final infiltrated article the refractory granules will be in contact with the infiltrant. In the practice of this invention such contact is essentially avoided in the final infiltrated article in order to obtain optimum physical properties. The volume diffusion described above occurs in this invention at relatively low temperatures, conducive to maintaining dimensional stability in the infiltrated article.

The first metal is present in the final shaped, infiltrated article in amounts between about 35 and about 70 volume percent, preferably in amounts between about 57 and about 62 volume percent. The granules of first metal used to make the final molded article can be regularly or irregularly shaped particles having an original mean diameter of about 1 to about 100 micrometers, preferably about 1 to about 44 micrometers. Suitable first metals include powdered iron, powdered ferro alloys and other metals which satisfy the above homogenity, Rockwell hardness, and volume diffusion criteria, such as "1018" (see AISI type 1018) low carbon steel, molybdenum, nickel, manganese, and cobalt. Copper can be used as the first metal if a lower melting metal or alloy (such as some copper alloys) is used as the infiltrant. A powdered ferro alloy known as "$A_6$" tool steel (see AISI type $A_6$) having a typical composition 94.7% Fe, 2.25% Mn, 1.35% Mo, 1.0% Cr, 0.7% C, and 0.3% Si is most preferred.

Organic binders suitable for use in this invention are those which melt or soften at low temperatures, e.g. less than 180° C., preferably less than 120° C., thereby providing the metal powder-organic binder mixture with good flow properties when warmed and yet allowing the powder-binder mixture to be solid at room temperature so that a green article molded therefrom can be normally easily handled without collapse or deformation. The binders used in this invention are those which are heat fugitive, that is, which burn off or volatilize when the green molded preform is heated. Preferred heat fugitive binders degrade without causing internal pressures on the resulting skeletal preform (which promote internal fractures) and without leaving substantial binder residue in the skeletal preform. Preferably, during heating of the molded mixture of refractory granules and powdered first metal, the chosen binder grandually degrades or decomposes at a low temperature and leaves a minimal carbonaceous residue.

Organic thermoplastics or mixtures of organic thermoplastics and organic thermosets are used as binders. Thermoplastic materials generally leave lower carbonaceous residues than thermoset materials when thermally degraded. However, use of a thermoset-containing binder yields a molded powder-binder shape with a higher green strength and may offer manufacturing advantages. The use of a mixture of thermoplastic and thermoset binder is advantageous when large composite articles are prepared, such as articles in which some of the binder degradation products must escape from the internal portion of the article through a distance greater than about 2 cm. In such cases, a step-wise burn-off of the binder is preferred in order to avoid a spontaneous exotherm of the binder which could generate internal pressure resulting in multiple internal fractures in the molded article. Such a step-wise burn-off is carried out by heating the green molded article to two or more successive temperatures, those temperatures being the individual decomposition temperatures of the thermoplastic and thermoset portions of the binders. Alternatively, the thermoplastic portion of the binder may be substantially removed by solvent leaching followed by thermal degradation of the thermoset portion of the binder.

A further alternative binder system employs a diluent with the binder. The diluent volatilizes prior to any significant binder degradation and thus provides open passage for the thermal degradation products during burn-off, reducing or elimating internal fractures in the molded article.

Examples of thermoplastic binders include paraffin, e.g. "Gulf Wax" (household grade refined paraffin), a combination of paraffin with a low molecular weight polyethylene, mixtures containing oleic or stearic acids or lower alkyl esters thereof, e.g. "Emerest" 2642 (polyethylene glycol distearate, average molecular weight of 400) as well as other waxy and paraffinic substances having the softening and flow characteristics of paraffin.

Representative thermosetting binders which can be used in combination with thermoplastics include epoxide resins, e.g. diglycidyl ethers of bisphenol A such as 2,2-bis[p-(2,3-epoxypropoxy)phenyl] propane, which can be used with appropriate curing catalysts. Care must be exercised so as not to thermally induce cross-linking during the mixing and molding steps when thermosetting binders are used.

Representative solvents which can be used for leaching out the thermoplastic portion of a thermoplastic and thermoset binder mixture are ketones such as acetone or methyl ethyl ketone, and aqueous solvents. Diluents for use with "diluted" binder systems include liquids which are good solvents for the uncured binder but poor solvents for the cured binder. The diluent should not be absorbed by the flexible molding material. Also, the diluent should have a sufficiently high boiling point so that it does not boil away before curing or setting of the binder, and a sufficiently low boiling point so that the diluent volatilizes before the binder begins to thermally degrade. Preferred diluents are those which volatilize at temperatures of about 150° C. to 210° C., such as low molecular weight polyoxyglycols and light hydrocarbon oils. A preferred diluent is 1,3-butanediol (B.P. 204° C.).

The infiltrant (i.e., the second metal) in the final shaped article has a melting temperature below the melting temperature of the first metal. Also, the infiltrant is a solid in the final article at room temperature. The infiltrant must also "wet" the skeleton. Such wetting can occur either because the infiltrant wets the first metal or because the principal metal component within the infiltrant (or an alloying ingredient within the infiltrant) reacts to form an alloy with the first metal, which alloy coats the first metal and is wet by the infiltrant. Wetting of the skeleton by the infiltrant can be determined empirically (by testing to see if infiltration occurs) or by determining if the infiltrant will wet the first metal according to the sessile drop test. Wettable combinations of infiltrant and first metal will have a sessile drop test wetting angle of 90° or less under a hydrogen atmosphere. The sessile drop test is described, for example, in "Wetting of Ceramic Oxides by Molten Metals under Ultra High Vacuum", F. L. Harding and D. R. Rossington, J. Am. Cer. Soc. 53, 2, 87–90 (1970) and in "The Wetting of TaC by Liquid Cu and Liquid Ag", S. K. Rhee, J. Am. Cer. Soc. 55, 3, 157–159 (1972). The empirical test is the most reliable indication that the infiltrant will wet the skeleton, because the wetting of the skeleton which occurs may be due to the above described formation of intermediate alloys of first metal with infiltrant (or an alloying ingredient present in the infiltrant). Formation of such wettable alloys may be difficult to predict in advance. However, the sessile drop test is generally reliable and serves as a useful guide in predicting whether or not the infiltrant will wet the skeleton.

Also, the infiltrant has a Rockwell hardness less than or equal to the Rockwell hardness of the first metal, measured under similar testing conditions according to the above ASTM test. Satisfaction of the above hardness condition and satisfaction of the first metal hardness condition mentioned earlier requires that in an article of this invention, the refractory has the highest hardness in the composite article, the first metal has an intermediate hardness, and the infiltrant has the lowest hardness. Because hardness and impact strength are inversely related, the infiltrant has an impact strength which is higher than the impact strength of the first metal, measured according to ASTM E-23-72 (Reapproved 1978).

Preferably, the first metal and infiltrant are not substantially soluble in one another, although this is not required for the practice of the present invention.

The infiltrant occupies about 15 to about 50 volume percent, and preferably 25 to about 35 volume percent, of the final molded, infiltrated article. The infiltrant can be used in any convenient form (e.g., granules, sheets, foil, or beads) as it is melted during infiltration of the skeleton. Suitable infiltrants include copper, copper alloys, copper-manganese alloys, silver, silver alloys, tin, tin alloys, iron, and multicomponent alloys such as ferroalloys. Copper and copper alloys are preferred infiltrants, especially when iron or ferroalloy powders are used as the first metal. In addition, when such iron or ferroalloy powders are used as the first metal, then copper-manganese alloys containing about 4 to about 35 weight percent manganese are a preferred infiltrant. The presence of manganese in the infiltrant results in the formation of an intermediate layer of austenitic iron at the interface between the first metal and infiltrant and the enhancement of the gradient microstructure within the final molded article. Other alloying ingredients can be added to the infiltrant to enhance the properties of the final molded article. For example, in an article of this invention containing iron or ferroalloy first metal and copper alloy infiltrant, the presence of boron, magnesium, or silver as alloying ingredients will enhance the fluidity of the molten infiltrant. The presence of nickel and tin as alloying ingredients in such an article will enhance the toughness of the article through promotion of spinodal decomposition as the infiltrant cools. The presence of iron as an alloying ingredient in such an article will decrease the corrosive action of the infiltrant upon the skeleton and thereby improve the dimensional stability of the molded article. Silicon, when present as an alloying ingredient in such a system, will act as a deoxidizer for the other alloying ingredients of the infiltrant.

The articles of this invention can contain other materials (e.g. dissolved gases) if such materials are desired in order to alter the physical properties of the final article. However, the presence of such materials is not required in this invention, and the articles of the invention can consist essentially of refractory, first metal, and infiltrant.

When a skeletal preform containing the above described refractory granules and powdered first metal is placed adjacent the above described infiltrant and heated above the melting point of the infiltrant, the infiltrant will melt and "wick" into the interior of the preform. Additional heating (to the temperature at which the first metal undergoes volume diffusion) results in substantial rearrangement of components within the composite by solid state reactions involving refractory, first metal and molten infiltrant. Granules of the first metal undergo volume diffusion, merging with one another and enveloping individual refractory granules. The first metal assumes the form of a continuous skeleton within which are enveloped the refractory granules. The infiltrant fills the connected porosity of the skeleton, and is in contact with the first metal but no longer in contact with the refractory granules (which have become enveloped in the first metal). On cooling, the rearranged composite structure is preserved, thereby locking-in or retaining the spaced position of the encircled refractory granules. Optionally, at the interface between refractory granules and the first metal, crystalline compositions of first metal and refractory can form into one or more intermediate concentric shells or zones surrounding an individual refractory granule. In addition, if the infiltrant contains a component which will react with the first metal (e.g., when manganese is present in the infiltrant and the first metal contains iron), then, at the interface between the first metal and infiltrant, additional crystalline compositions of first metal and the reactive infiltrant component can optionally form into one or more intermediate shells or zones adjacent the first metal and bulk of the infiltrant.

Examination of a polished metallurgical section of a finished composite article of this invention under optical magnification shows that the refractory granules retain their original particle shape and spacing. The particles of first metal lose their original particle shape and become a continuous skeletal structure. The finished composite article exhibits relatively little dimensional change when compared to the master from which the preform was molded. Dimensional change of a shaped article of this invention prepared from tungsten carbide, $A_6$ tool steel, and copper according to the present invention is generally less than about 1 percent in any lineal dimension, and preferably less than about 0.5 percent. This low degree of dimensional change is surprising in view of the extensive dimensional change, occuring as shrinkage of up to about 7 percent, which occurs when a composite is prepared from granulated iron infiltrated with copper.

Shrinkage in the articles of this invention is minimized in spite of the large amount of volume diffusion occuring during infiltration. Volume diffusion is one mechanism by which sintering is carried out in the art of powder metallurgy. Other known sintering mechanisms include viscous or plastic flow, evaporation and condensation, and surface diffusion. All of these sintering mechanisms generally promote shrinkage in the sintered article. Sintering in the articles of this invention appears to occur by a uniquely different mechanism than that which is generally known to occur in powder compacts or "green" parts. The formation of a gradient microstructure occurs as a particle encirclement by diffusional transport which takes place during infiltration under solid state conditions, i.e., well below the melting point of the first metal. The presence of refractory particles which are greater than one micrometer in size and the selection of first metal is critical to maintaining dimensional stability in the final article. As encirclement of refractory granules by the first metal proceeds, a slight amount of shrinkage results due to formation of the gradient microstructure. However, shrinkage does not become excessive because a band of first metal forms a continuous path between refractory particles. The skeletal structure formed by the first metal is insensitive to the erosive and corrosive action of the infiltrant, and the spacing between individual refractory granules remains constant, because part of the narrow band or link of first metal between refractory granules is not in contact with the infiltrant and does not undergo further diffusion.

The finished composite article has excellent fidelity of replication when compared to the master from which the preform was molded. Compositions prepared according to the present invention have particular utility in the manufacture of molded die cavities. Such molded die cavities may be used in injection molding of plastics or stamping of ductile metals which are formed into parts having complex shapes corresponding to the shape of the molded die cavity.

The method of forming a composite article according to the present invention involves mixing refractory granules and powdered first metal with a heat fugitive, organic binder, molding the powder-binder mixture, setting or curing the mold contents, removing the bulk of the binder, thereby forming a skeletal preform, and infiltrating the preform with molten infiltrant.

Figure 2:
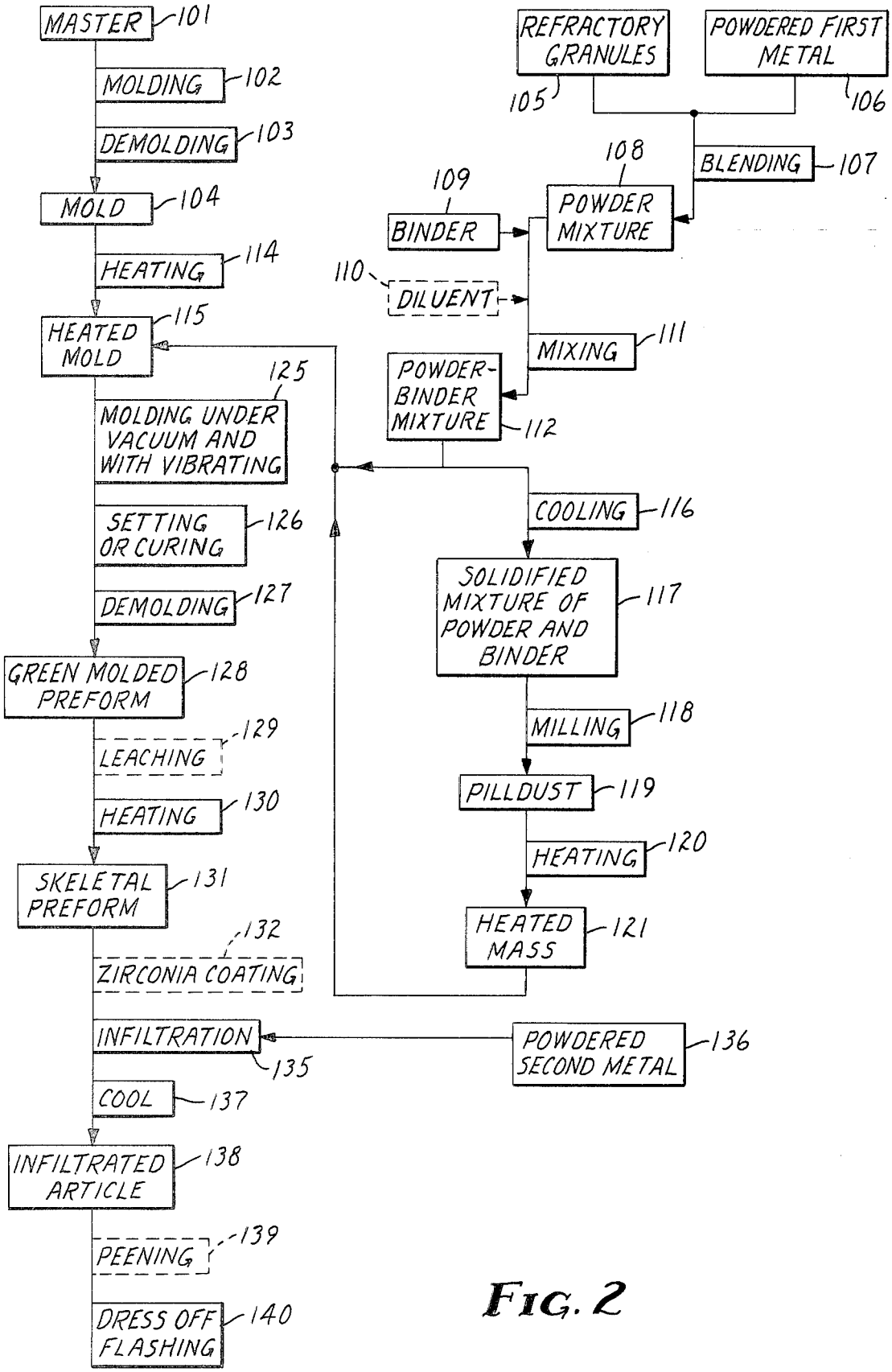
FIG. 2 is a flow diagram showing the manufacture of a precision shaped article of this invention.

Referring to FIG. 2, which illustrates a method for forming an article of this invention, a replicating master 101 is used to mold 102 a flexible form in the desired shape by surrounding the master with an elastic, rubbery, molding compound, and demolding 103 the master from the cured solid rubbery mold 104. An admixture of refractory granules 105 and powdered first metal 106 is blended 107 to form a powder mixture 108 which is next combined with a heat fugitive thermoplastic or thermoplastic and thermosetting binder 109 and any optional diluents 110 by mixing 111 (without causing premature cure of the binder if a thermosetting binder is used) in a blending device, e.g. a sigma blade mixer, resulting in formation of a powder-binder mixture 112. The refractory granules and powdered first metal are uniformly dispersed in the binder matrix conducive to forming a preform with homogeneous (i.e. uniform) density which will be essentially uniformly porous when the binder is thermally degraded.

The flexible mold 104 is heated 114 and the powder-binder mixture 112 fed directly to the heated mold 115. Optionally, instead of immediately molding the powder-binder mixture, a mixture made with a thermoplastic binder can be cooled 116 to a solidified mass 117 and milled 118, preferably in a vacuum, to a granular or free-flowing consistency ("pill dust" 119) for easy handling and storage, and subsequently heated 120 to a heated mass 121 at the time of the molding step. The heated mold and its contents (the powder-binder mixture 111 or heated mass 121) are vibrated under vacuum 125 in order to degas the mixture. The mold contents are allowed to set or cure 126 and harden. The molded granule-binder shape is demolded 127 by applying a vacuum to the outer walls of the flexible mold. After demolding, the resultant "green" molded preform 128 is a faithful replica of the dimensions of the master. This molded shape has good green strength and uniform density due to the hardened matrix of binder which holds the refractory granules and powdered first metal together.

If a mixture of thermoplastic and thermoset binders was used to make the green molded preform, then the thermoplastic binder can be partially removed from the green molded preform by optionally leaching 129 the preform in a solvent such as methylethylketone or water for a period of about 4 to about 12 hours or less.

The green molded preform 128 is packed in a nonreactive refractory powder, e.g. alumina or silica, to prevent sagging or loss of dimension, and subsequently heated 130 in a furnace to a temperature of about 780° C. to thermally degrade the binder. If mixtures of thermoplastic and thermoset binders are used, or if diluted binders are used, the heating step is carried out in a series of stages in order to first remove those materials which boil off or degrade at low temperatures, followed by removal of the remainder of the binder. During the heating step, the bulk of the binder is removed from the article by vaporization and as gaseous products of degradation, leaving a minute amount of amorphous carbonaceous residue which may help to tack the refractory granules and powdered first metal together. The refractory granules, powdered first metal, and carbonaceous residue form a rigid, handleable, skeletal preform 131. The refractory granules and particles of powdered first metal are in contiguous relationship. They are interconnected or adhered together and essentially retain their original particle shapes and relative positions when viewed under optical magnification.

A skeletal preform made by the above heat fugitive binder method will have minimal closed porosity. The major portion of the void space in such a preform will represent connected porosity. Only connected porosity can be filled by molten infiltrant.

The preform is next infiltrated with the infiltrant. The surfaces of the skeletal preform which will be coincident with the working surfaces of the final infiltrated article are preferably coated 132 with a dispersion of zirconia in acetone in order to eliminate overwetting, i.e. "beading" of infiltrant at those surfaces of the skeletal preform. The infiltration step 135 is preferably carried out by supporting the skeletal preform 131 and infiltrant (second metal) 136 in or on a bed of alumina in a crucible, for example, one made of graphite, alumina, or mullite. The infiltrant (in solidified form) is placed in contact with the base of the skeletal preform and heated above the melting point of the infiltrant to a temperature at or above the temperature at which the first metal undergoes volume diffusion, but to a temperature below the melting point of the first metal. Infiltration (and the attendant volume diffusion of the first metal and encirclement of the refractory granules by the first metal) is preferably carried out at the lowest temperature at which volume diffusion is observed to occur. The amount of infiltrant is usually chosen to be slightly in excess of the amount necessary to fill the connected porosity of the skeletal preform (as determined by calculation or empirically). When the melting point of the infiltrant has been reached, the infiltrant will melt and "wick" into the interior (the connected porosity) of the skeletal preform by capillary action. Heating is continued until the temperature at which the first metal undergoes volume diffusion is reached (this temperature may be the same as the melting point of the infiltrant or a higher temperature). The infiltrated preform is then cooled 137, the infiltrated article 138 extracted, and any excess zirconia coating is removed, e.g., by peening 139 with a glass bead peening apparatus (Empire Abrasive Equipment Corp. Model No. S-20) at a pressure of 1.4 to 2.8 kg/cm$^2$ using an 8 mm diameter orifice. If an age hardenable infiltrant is employed, e.g. copper alloyed with nickel (15%) and tin (7%), or if the metal skeleton is hardenable, the infiltrated article may be subjected to a temperature aging cycle, using techniques well known in the art of metalworking, to change the grain structure of the interior or surface of the composite and increase the hardness and/or wear resistance of the infiltrated article. Finally, excess flashing is dressed off 140 and any superfluous base material is machined or cut away from the shaped working surface to produce the finished infiltrated molded article.

The time and temperature necessary to infiltrate the preform and ensure that volume diffusion of the first metal occurs will vary depending upon the choice of first metal, the rate of heating, the gross dimensions of the preform being infiltrated, the wetting characteristics of the infiltrant, and the diameter of the pore-like passages within the skeleton. These times and temperatures are determined empirically using microscopic analysis of the infiltrated sample. An infiltrated article which has been insufficiently heated will not undergo volume diffusion. Microscopic analysis of such an article will reveal that the particles of powdered first metal have not lost their original shapes and have not enveloped the refractory. An infiltrated article which has been excessively heated may undergo liquid phase reactions of the first metal due to melting of the first metal. Microscopic analysis of such an excessively heated article will reveal that the refractory granules have been greatly reduced in size due to reaction with the first metal. In addition, an excessively heated article may be characterized by severe distortion or dimensional change relative to the desired master shape.

The resulting infiltrated molded article, such as a copper infiltrated article, is substantially void-free (i.e., it has a density at least 97% and usually 99% or more of the theoretical density based upon the densities of the constituents of the preform and of the infiltrant phase). Essentially the only uninfiltrated space in such an infiltrated article is the closed porosity of the original preform. The connected porosity of the original preform is essentially completely occupied by the infiltrant.

Figure 3:
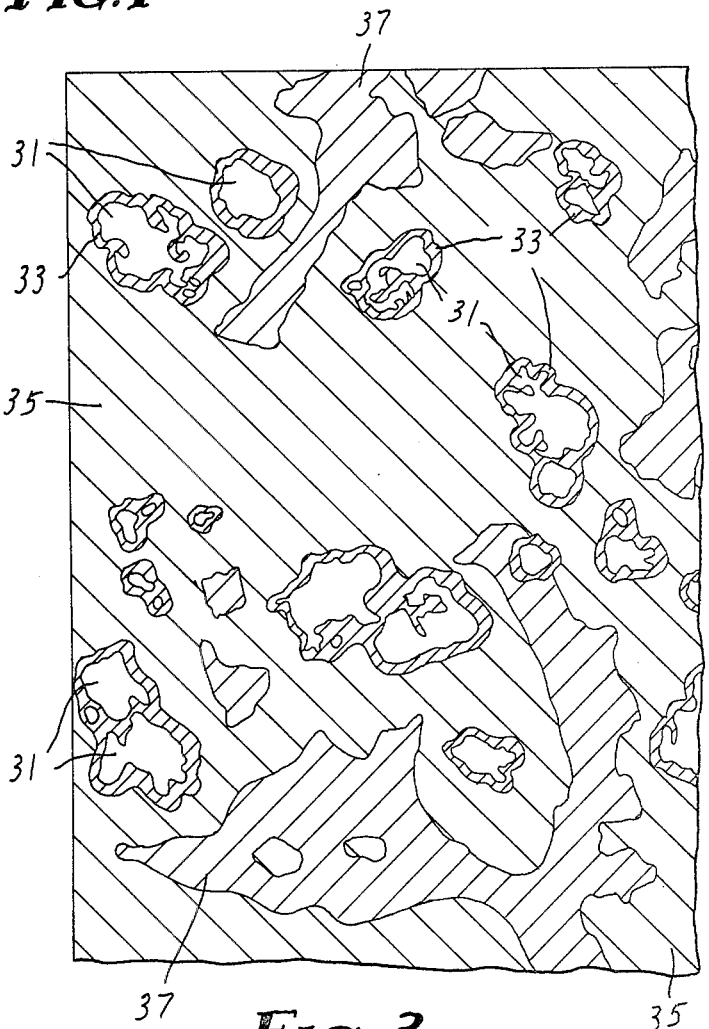
FIG. 3 is a pen-and-ink sketch of an optical micrograph of an article of this invention.

The metallurgical structure of an infiltrated molded article of the present invention can be further understood by reference to FIG. 3. FIG. 3 is a pen-and-ink drawing of an optical micrograph (taken at a magnification of 750×) of a polished sample of the present invention, prepared as described in Example 1. Tungsten carbide granules 31 are surrounded by a thin shell or film 33 containing an alloy of iron, tungsten, and carbon. Film 33 is further surrounded by an interconnected skeletal iron matrix 35. Iron matrix 35 is in turn intermeshed with copper matrix 37. When the article depicted in FIG. 3 abrades against another surface, tungsten carbide granules 31 provide good abrasion resistance and high hardness. Tungsten carbide granules 31 will tend to protrude above the working surface of the article depicted in FIG. 3 as that surface wears away. Additional wear at the surface will result in the exposure of new tungsten carbide granules 31. When the article depicted in FIG. 3 receives an impact, the shock of that impact will be transmitted into the interior of the article. These shocks travel as shock waves which pass through the tungsten carbide granules 31 and the metallic materials 33, 35 and 37 of the article. Shock waves passing from tungsten carbide granules 31 to alloy 33 are dispersed due to the lower elastic constant (a factor related to hardness) of the alloy 33. In turn, as those shock waves pass through iron 35, and then copper 37, they are further dispersed due to the lower elastic constant of iron and copper. The hardest substance in such a composite material is tungsten carbide, and the softest (and most impact resistant) substance in such a composite material is copper. There is an essentially smooth, graduated change in hardness, impact resistance, and energy absorbing ability throughout the material from the tungsten carbide granules to the copper matrix. Due to its microstructure and the gradient in hardness and impact resistance from point to point within the composite, the final molded article exhibits a high resistance to impact (between that of the refractory and infiltrant)

while maintaining a high hardness (between that of the refractory and infiltrant). The composite material shown in FIG. 3 has particular utility as a molded die cavity.

Figure 4:
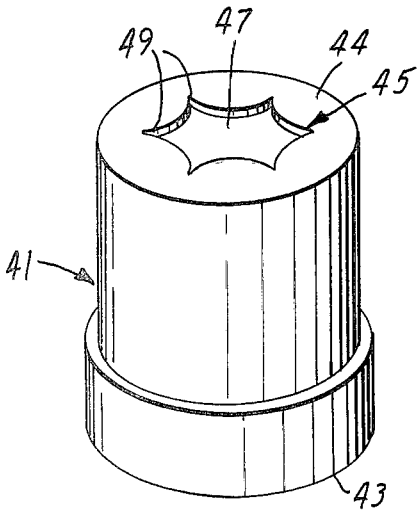
FIG. 4 is a view in perspective of a molded die cavity of this invention.

A molded die cavity prepared according to the present invention can be further understood by reference to FIG. 4. FIG. 4 is a perspective view of a molded die cavity 41 having a base 43 and a working surface 44. Female recess 45 lies in the end of cavity 41 opposite the base and has indented surface 47 and scallops 49. The shape of recess 45 corresponds to a male shape in the form of a fluted wheel.

Objects and advantages of this invention are illustrated in the following examples but the amounts and materials described in the examples, and various additions and details recited therein, should not be construed to limit the scope of this invention.

EXAMPLE 1

A Charpy unnotched impact bar was machined to the dimensions specified in ASTM E-23-72 (Reapproved 1978). A mold corresponding to this shape was made by surrounding the bar with "RTV-J" curable silicone rubber. The mold was cured and the bar removed from the mold. Ninety grams of tungsten carbide granules having 1 to 15 micrometers mean diameter ("Type 111", commercially available from Wah Chang Div. of Teledyne) and 210 grams of powdered $A_6$ tool steel having a mean diameter less than 44 micrometers (commercially available from Stellite Div. of Cabot Corp.) were dry mixed in a V-blender and heated to 66° C. Thirteen grams of a polymer binder ("Emerest 2642", commercially available from Emery Industries) were separately preheated to 66° C. The powders and polymer binder were combined in a sigma blade mixer which had been heated to 66° C. The mixture was milled for about 15 minutes and resulted in a thixotropic warm powder-binder mixture containing approximately 27.7 volume percent binder.

The warm powder-binder mixture and the flexible rubber mold were heated to 66° C. by storing them in a 66° C. oven for about 15 minutes. The warm powder-binder mixture was then flowed into the warm flexible mold by vibratory means. The mixture was deaired for 15 minutes with continued vibration in a laboratory vacuum chamber operated at 1 torr. The mold and contents were then cooled to 0° C. in a freezer and the hardened, "green" molded preform subsequently extracted from the rubber mold cavity using vacuum.

The green molded preform was placed in a supporting bed of powdered alumina and heated in a resistance heated box furnace with a dynamic argon atmosphere. A temperature of approximately 400° C. was sufficient to volatilize and thermally degrade most of the binder. Heating was discontinued when the temperature reached 780° C., at which point the binder had completely degraded and the skeletal particles in the matrix had become tacked together.

The molded skeletal preform was removed from the furnace after it had cooled to room temperature. An acetone dispersion of zirconia (50% by volume) was applied to all but one surface (the base) of the preform in order to prevent the infiltrant metal from overwetting the working surfaces. The base of the preform was then placed adjacent 50 g of solid copper on a bed of alumina in an open graphite crucible in a molybdenum wound electrical resistance furnace. The furnace was evacuated to 0.1 torr, backfilled with nitrogen, purged and then refilled with hydrogen to atmospheric pressure and maintained at a flow rate of 0.5 liters/sec. The furnace was heated to 1083° C. and held just above that temperature for 45 minutes in order to carry out infiltration of the skeletal preform by copper infiltrant and volume diffusion by the first metal. The furnace was then turned off and allowed to cool normally. Microscopic analysis of a metallurgically prepared sample of this composite shows that the $A_6$ tool steel surrounds the WC. Also, a definite and distinct intermediate alloy of WC together with Fe can be seen between the refractory and $A_6$.

Shrinkage was measured by comparing the master shape to the final molded article. The article was tested for abrasion resistance by sliding it across 220 grit silicon carbide coated abrasive paper. Using hand pressure, the article slid across the abrasive surface much more freely than a similarly sized block of tool steel having Rockwell hardness of 50. No scoring was observed on the article of this invention, but scoring was visually apparent on the tool steel block. The article was tested for Rockwell C hardness and Charpy unnotched impact according to ASTM E-103-61 (Reapproved 1979) and ASTM E-23-72 (Reapproved 1978). The final molded article exhibited the following characteristics:

Dimensional Change: −0.4%

Rockwell hardness ($R_c$): 49

Charpy unnotched impact (CIU): 15.1 joules (11.1 ft.lbs)

EXAMPLES 2 THROUGH 3

Using the method of Example 1, molded composite articles were prepared by substituting various materials for the $A_6$ powder used in Example 1. Set out below in Table 2 are the first metal used, and the shrinkage, Rockwell hardness, and Charpy unnotched impact values for the resulting composite.

TABLE 2

| Example | First metal | Dimensional change,% | $R_c$ | CIU,joules |
|---|---|---|---|---|
| 2 | Fe | −0.35% | 4 to 8 | 78.0 (57.5 ft.lbs.) |
| 3 | 1018 steel | −0.095% | 25 to 31 | 31.3 (23.1 ft.lbs.) |

EXAMPLES 4 THROUGH 6

Using the method of Example 1, molded composite articles were prepared using tungsten carbide refractory, $A_6$ tool steel first metal, and two copper-manganese alloy second metal infiltrants. Set out below in Table 3 are the composition, shrinkage, Rockwell hardness, and Charpy unnotched impact values for the resulting composite articles.

Microscopic analysis of metallurgically prepared samples of these composites shows that the $A_6$ tool steel encircles the tungsten carbide. Also, a definite and distinct intermediate alloy of manganese-steel alloy can be seen between the $A_6$ tool steel and the copper-manganese infiltrant. This intermediate alloy is austenitic iron, a material known to have extreme toughness.

TABLE 3

| Example | WC[a] % | $A_6$[a] % | CuMn alloy | Dimensional change, % | $R_c$ | CIU,joules |
|---|---|---|---|---|---|---|
| 4 | 40 | 60 | Cu35Mn[b] | −0.41 | 33–44 | 56.4 (41.5 ft.lbs) |
| 5 | 30 | 70 | Cu35Mn[b] | −0.28 | 17–37 | 80.2 (59 ft.lbs) |

TABLE 3-continued

| Example | WC[a] % | $A_6$[a] % | CuMn alloy | Dimensional change, % | $R_c$ | CIU,joules |
|---|---|---|---|---|---|---|
| 6 | 30 | 70 | Cu10Mn[c] | −0.30 | 20–44 | 26.4 (19.4 ft.lbs) |

[a]Weight percent based on the uninfiltrated skeletal preform. Final infiltrated articles contained about 32 to 34 volume percent infiltrant.
[b]Cu35Mn is 65 weight percent Cu and 35 weight percent Mn
[c]Cu10Mn is 90 weight percent Cu and 10 weight percent Mn

EXAMPLES 7 through 15

Using the method of Example 1, molded composite articles were prepared by substituting several materials for the refractory and first metal used in Example 1. The composite articles were sectioned and analyzed to determine whether or not the refractory particles had become fully enveloped by the first metal. Set out below in Table 4 are the refractory, first metal, infiltration time and temperature, and whether or not the refractory granules were fully enveloped by the first metal. Note that in Examples 10 and 12 full envelopment did not occur, but that an increase in infiltration temperature or infiltration time brought about full envelopment of refractory.

TABLE 4

| Example | Refractory | First metal | time | temperature | Refractory fully enveloped? |
|---|---|---|---|---|---|
| 7 | $TiB_2$[a] | $A_6$[b] | 12 hrs | 1100° C. | yes |
| 8 | WC + SiC[c] | $A_6$[d] | 12 hrs | 1100° C. | yes |
| 9 | WC[a] | Mo + Fe[e] | 12 hrs | 1100° C. | yes |
| 10 | WC[f] | $M_2$[g] | 45 min | 1100° C. | no |
| 11 | WC[f] | $M_2$[g] | 45 min | 1250° C. | yes |
| 12 | WC[f] | $A_6$[h] | 15 min | 1100° C. | no |
| 13 | WC[f] | $A_6$[h] | 45 min | 1100° C. | yes |
| 14 | $B_4C_3$[i] | Fe[j] | 12 hrs | 1100° C. | yes |
| 15 | W[k] | Fe[l] | 45 min | 1100° C. | yes |

[a]9 volume percent (v/o)
[b]62 v/o
[c]10 v/o WC + 2 v/o SiC
[d]59 v/o
[e]29 v/o Mo + 33 v/o Fe
[f]13 v/o
[g]58 v/o AISI type $M_2$, containing 0.82 v/o C, 0.3 v/o Mn. 0.2 v/o Si, 4.25 v/o Cr, 5 v/o Mo, 6.25 v/o W, 1.80 v/o V, balance Fe
[h]58 v/o
[i]10 v/o
[j]61 v/o
[k]11 v/o
[l]60 v/o

EXAMPLE 16

Using the method of Example 1, a molded composite article was prepared having 13 volume percent tungsten carbide refractory, 58 volume percent $A_6$ tool steel first metal, and 29 volume percent of a copper alloy infiltrant. The infiltrant contained 45 volume percent copper, 25 volume percent silver, 10 volume percent nickel, 5 volume percent iron, 12 volume percent tin, 1 volume percent boron, 0.05 volume percent magnesium, and 0.1 to 0.2 volume percent silicon. The resulting composite article exhibited dimensional change of −0.32 percent, Rc of 52, and a charpy unnotched impact strength of 15 joules (11 ft. lbs.).

Various modifications and alterations of this invention will be apparent to those skilled in the art without departing from the scope and spirit of this invention and the latter should not be restricted to that set forth herein for illustrative purposes.

What is claimed is:

1. A metal composite article comprising:

(a) less than about 15 percent of the volume of said article of granules of a refractory of about 1 to about 100 micrometers mean diameter, said refractory being (i) metal carbide, boride, oxide, silicide, or nitride, (ii) metal selected from the group consisting of tungsten, molybdenum, tantalum, niobium, vanadium, and titanium, or (iii) combinations thereof;

(b) a monolithic skeleton comprising about 35 to about 70 percent of the volume of said article of a solid first metal or alloy which has a homogeneous crystalline appearance at a temperature below its melting point when viewed under an optical microscope and has lower Rockwell hardness than said refractory, said first metal or alloy fully enveloping said refractory granules, the latter being uniformly dispersed in said skeleton; and (c) about 15 to about 50 percent of the volume of said article of a continuous metallic phase occupying the connected porosity in said skeleton, said continuous phase comprising a solid second metal or alloy which wets said skeleton, has a Rockwell hardness less than or equal to the Rockwell hardness of said first metal or alloy, and has a melting point below the melting point of said first metal or alloy;

said article thereby comprising two intermeshed matrices and being substantially free of voids.

2. An article according to claim 1, wherein said refractory is a metal carbide, boride, oxide, silicide, or nitride.

3. An article according to claim 1, wherein said refractory is a metal selected from the group consisting of tungsten, molybdenum, tantalum, niobium, vanadium, and titanium.

4. An article according to claim 1, wherein said refractory is a metal carbide.

5. An article according to claim 1, wherein said refractory is tungsten carbide.

6. An article according to claim 1, wherein said refractory is about 8 to about 13 percent of the volume of said article.

7. An article according to claim 1, wherein said refractory granules have a mean diameter of about 1 to about 25 micrometers.

8. An article according to claim 1, wherein said refractory granules have a mean diameter of about 1 to about 15 micrometers.

9. An article according to claim 1, wherein said first metal is iron or ferroalloy.

10. An article according to claim 1 wherein said first metal or alloy is about 57 to about 62 percent of the volume of said article.

11. An article according to claim 1, wherein said first metal or alloy is $A_6$ tool steel.

12. An article according to claim 1, wherein said second metal or alloy is about 25 to about 30 percent of the volume of said article.

13. An article according to claim 1, wherein said second metal or alloy is copper or copper alloy.

14. An article according to claim 1, wherein said first metal is iron or ferroalloy and said second metal or alloy is copper and manganese.

15. An article according to claim 14, wherein said manganese is about 4 to about 35 percent of the weight of said second metal or alloy.

16. An article according to claim 1, further comprising at least one layer of an intermediate composition of refractory together with first metal disposed between said refractory granules and said first metal or alloy.

17. An article according to claim 1, further comprising at least one layer of intermediate alloy of said first metal or alloy and said second metal or an alloying metal present in said second metal or alloy, disposed between said first metal or alloy and said second metal or alloy.

18. An article according to claim 1, having a Rockwell hardness greater than about 50 and a Charpy unnotched impact strength greater than about 15 joules.

19. An article according to claim 1, having a density of at least 97 percent of the theoretical density based upon the densities of said refractory, said first metal or alloy, and said second metal or alloy.

20. An article according to claim 19, having a density of at least 99 percent of said theoretical density.

21. A precision molded die cavity comprising:

(a) 2 to 15 volume percent granules of tungsten carbide of about 1 to about 15 micrometers mean diameter;

(b) a monolithic skeleton of about 35 to about 70 volume percent iron or ferroalloy, said iron or ferroalloy fully enveloping said tungsten carbide granules, all of the latter being uniformly dispersed in said skeleton; and (c) a continuous metallic phase of about 15 to about 50 volume percent copper occupying the connected porosity in said skeleton;

said article thereby comprising two intermeshed matrices and being substantially free of voids.

22. A die cavity according to claim 21, wherein said tungsten carbide is about 8 to about 13 percent of the volume of said die.

23. A die cavity according to claim 21, wherein said iron or ferroalloy is about 57 to about 62 percent of the volume of said die.

24. A die cavity according to claim 21, wherein said copper is about 25 to about 30 percent of the volume of said die.

25. A die cavity according to claim 21, wherein said tungsten carbide is about 8 to about 13 percent of the volume of said die, said iron or ferroalloy is $A_6$ tool steel and is about 57 to about 62 percent of the volume of said die, and said copper is about 25 to about 30 percent of the volume of said die.

26. A die cavity according to claim 21, having a Rockwell hardness greater than about 50, a Charpy unnotched impact strength greater than about 15 joules, and a density of at least 97 percent of the theoretical density based upon the densities of said tungsten carbide, said iron or ferroalloy, and said copper.

27. A process for forming a precision molded composite article, comprising the steps of:

(a) blending granules of a refractory having about 1 to about 100 micrometers mean diameter with granules of a first metal or alloy having about 1 to about 100 micrometers mean diameter, said refractory being metal carbide, boride, oxide, silicide, or nitride, or a metal selected from the group consisting of tungsten, molybdenum, tantalum, niobium, vanadium, and titanium, or combinations thereof, said first metal or alloy having a homogeneous crystalline appearance at a temperature below its melting point when viewed under an optical microscope and lower Rockwell hardness than said refractory, thereby forming a uniform mixture;

(b) mixing said uniform mixture with up to 50 volume percent of a heat fugitive, organic binder, with the resulting mixture containing less than about 15 volume percent of said refractory and about 35 to about 70 volume percent of said first metal or alloy;

(c) molding the resulting mixture in a heated flexible mold, cooling said mold and its contents to room temperature, and demolding said contents by applying a vacuum to the outside of said mold thereby forming an essentially void-free green molded preform having the size and shape of said mold;

(d) heating said green molded preform to thermally remove said binder and form a rigid, handleable skeletal preform;

(e) placing said skeletal preform in contact with a second metal or alloy which will wet said skeleton and which has a Rockwell hardness less than or equal to the Rockwell hardness of said first metal or alloy;

(f) infiltrating said skeletal preform with said second metal or alloy by heating said skeletal preform and said second metal or alloy above the melting point of said second metal or alloy, but below the melting point of said first metal or alloy, whereby said second metal or alloy melts and wicks into the connected porosity of said preform by capillary action and said first metal or alloy fully envelopes said refractory granules, with the proviso that said refractory granules do not completely dissolve in said first metal or alloy; and (g) cooling the infiltrated part to room temperature to form a substantially void-free precision molded article.

28. A process according to claim 27, wherein said refractory is tungsten carbide.

29. A process according to claim 28, wherein said first metal or alloy is iron or ferroalloy.

30. A process according to claim 28, wherein said granules of first metal or alloy have about 1 to about 44 micrometers mean diameter.

31. A process according to claim 27, wherein said second metal or alloy is copper or copper alloy.

32. A process according to claim 27, wherein said second metal or alloy comprises copper and manganese.

33. A process according to claim 27, wherein said refractory is tungsten carbide, said first metal or alloy is iron or ferroalloy, said second metal or alloy is copper and is about 15 to about 50 percent of the volume of said article, and said molded article is a die cavity.

34. A process according to claim 27, wherein the change in any lineal dimension between the dimensions of said void-free green molded preform and the dimensions of said void-free precision article is less than about 1 percent.

35. A process according to claim 34, wherein said change in any lineal dimension is less than about 0.5 percent.

36. A process according to claim 34, wherein said article has a density at least 97 percent of the theoretical density of said article.

37. A process according to claim 34, wherein said article has a density at least 99 percent of the theoretical density of said article.

* * * * *

UNITED STATES PATENT AND TRADEMARK OFFICE

CERTIFICATE OF CORRECTION

PATENT NO. : 4,327,156

DATED : April 27, 1982

INVENTOR(S) : Kenneth R. Dillon and Richard N. Gardner

It is certified that error appears in the above—identified patent and that said Letters Patent is hereby corrected as shown below:

Column 1, line 20, replace "dissolved" with --- dissolve ---.

Column 2, line 12, replace "infiltration" with --- infiltrating ---.

Column 3, line 24, replace "perform" with --- preform ---.

Column 8, lines 30-31, replace "grandually" with --- gradually ---.

Column 17, lines 30-31, the headings "time" and "temperature" should read --- Infiltration time temperature ---.

Signed and Sealed this

Twentieth Day of July 1982

[SEAL]

Attest:

GERALD J. MOSSINGHOFF

Attesting Officer

Commissioner of Patents and Trademarks